US011970316B2

(12) United States Patent
Chapman et al.

(10) Patent No.: US 11,970,316 B2
(45) Date of Patent: Apr. 30, 2024

(54) STACKABLE CONTAINER WITH LID

(71) Applicant: Southern Champion Tray, LLC, Chattanooga, TN (US)

(72) Inventors: David Chapman, Chattanooga, TN (US); Elton Ross Farren, Lakewood, CO (US); Pascale Didit Grenier, Chattanooga, TN (US); Daniel Albert McCallie, Chattanooga, TN (US); Mark Steven Smith, Chattanooga, TN (US)

( * ) Notice: Subject to any disclaimer, the term of this patent is extended or adjusted under 35 U.S.C. 154(b) by 46 days.

(21) Appl. No.: 17/538,417

(22) Filed: Nov. 30, 2021

(65) Prior Publication Data

US 2022/0169414 A1 Jun. 2, 2022

Related U.S. Application Data

(60) Provisional application No. 63/119,552, filed on Nov. 30, 2020.

(51) Int. Cl.

| | |
|---|---|
| ***B65D 5/00*** | (2006.01) |
| ***B65D 5/20*** | (2006.01) |
| ***B65D 43/02*** | (2006.01) |

(52) U.S. Cl.

CPC ..... *B65D 5/0015* (2013.01); *B65D 5/2052* (2013.01); *B65D 43/0202* (2013.01)

(58) Field of Classification Search

CPC ..... B65D 5/0015; B65D 5/2052; B65D 43/0202; B65D 5/2047; B65D 5/64; B65D 5/244; B65D 5/28; B65D 5/667; B65D 5/68; B65D 5/4204; B65D 5/20; B65D 21/0234; B65D 5/24; B65D 2543/00361; B31B 50/734; B31B 50/73

USPC ..... 229/141, 114, 901, 125.29, 125.28, 146, 229/125.19, 125.27, 125.36, 125.01, 229/125.32, 186; 206/769, 776; 220/23.4, 4.24

See application file for complete search history.

(56) References Cited

U.S. PATENT DOCUMENTS 3,027,062 A * 3/1962 Huss ..... B65D 5/28 229/125.32
4,470,538 A * 9/1984 Heathcock ..... B65D 5/6697 229/125.08
4,804,137 A * 2/1989 Harby ..... B65D 5/2047 229/114
4,856,707 A * 8/1989 Lorenz ..... B65D 5/64 229/199
5,060,851 A * 10/1991 Lorenz ..... B65D 21/0234 220/4.24
5,160,081 A * 11/1992 Beales ..... B65D 5/2047 229/114

(Continued)

*Primary Examiner* — Christopher R Demeree
(74) *Attorney, Agent, or Firm* — Chambliss, Bahner & Stophel, P.C.

(57) ABSTRACT

An enclosable and stackable container comprising a tray and lid is provided with structural elements to permit rapid covering and uncovering of the tray, efficient stacking of containers, and safe transportation. At least one catching mechanism may be engaged quickly to securely cover the tray and its food contents and disengaged quickly to uncover the tray and its food contents, improving food hygiene practices. Foldable flange flaps enhance stacking strength to permit safe transportation of stacked containers and their food contents.

17 Claims, 6 Drawing Sheets

(56) References Cited

U.S. PATENT DOCUMENTS

| | | | | |
|---|---|---|---|---|
| 5,188,284 | A * | 2/1993 | Eisman | B65D 5/64 229/110 |
| 6,092,719 | A * | 7/2000 | Capo | B65D 5/2047 229/114 |
| 8,056,799 | B2 * | 11/2011 | Burke | B65D 5/667 229/114 |
| 11,383,896 | B2 * | 7/2022 | Oliveira | B65D 43/06 |
| 11,661,246 | B2 * | 5/2023 | Sill | B65D 5/2047 229/125.01 |
| 2016/0251108 | A1 * | 9/2016 | Gungner | B31B 50/81 229/125.36 |

* cited by examiner

STACKABLE CONTAINER WITH LID

CROSS-REFERENCE TO RELATED APPLICATIONS

This application claims priority to U.S. Provisional Patent Application No. 63/119,552 filed Nov. 30, 2020, which application is incorporated herein by reference in its entirety.

BACKGROUND OF THE INVENTION

Field of the Invention

The present invention is directed generally to a container with a lid, and more particularly to an enclosable, stackable, and leak-resistant container.

Technology in the Field of the Invention

Food transportation, storage, and consumption may be difficult and unhygienic processes, presenting challenges to retail food service businesses, meal service providers, and food consumers. In a home or restaurant setting, food may be placed on durable, reusable plates at or near the site of consumption, limiting exposure of the food to airborne or surface pathogens prior to consumption. Food is at greater risk of contamination when, prior to its consumption, it must be transported significant distances and by means of several intermediaries.

The risk of food contamination is particularly high during an epidemic or pandemic. Consumers and regulators are more aware of potential food contamination from viral particles in aerosols and on surfaces during viral outbreaks such as during the COVID-19 pandemic. Severe acute respiratory syndrome coronavirus 2 (SARS-CoV-2), the causative agent of COVID-19, remains viable in aerosols for 3 hours and its stability is similar to that of severe acute respiratory syndrome coronavirus 1 (SARS-CoV-1). This suggests that efforts to prevent food contamination by SARS-CoV-2 may prove useful to prevent food contamination by other coronaviruses and pathogens in general. The following non-essential publication is incorporated by reference in its entirety to aid in the understanding of virion viability in aerosols and on inanimate objects: van Doremalen, N., et al. (2020). "Aerosol and Surface Stability of SARS-CoV-2 as Compared with SARS-CoV-1." *New England Journal of Medicine* 382(16): 1564-1567.

Lingering uncertainty around pathogen viability on surfaces and in food suggests that rising demand for better food hygiene practices will persist beyond any given outbreak, including that fueling the COVID-19 pandemic. Even as the immediate threat of a pandemic wanes, consumers are likely to take greater lifestyle and well-being precautions to limit bacterial and viral contagion.

Many meals are prepared and served to people away from their homes in a variety of settings every day. According to one analysis in the American Journal of Public Health, in 2019 the National School Lunch Program and School Breakfast Program served 15 million breakfasts and 30 million lunches daily. Before the COVID-19 pandemic, many of these meals were provided in group settings, but the COVID-19 pandemic necessitated changes in food distribution techniques, including meal formats and packaging. The following non-essential publications are incorporated by reference in their entirety to aid in the understanding of food safety and innovation in meal service: Olaimat, A. N., et al. (2020). "Food Safety During and After the Era of COVID-19 Pandemic." *Frontiers in Microbiology* 11(1854); Kinsey, E. W., et al. (2020). "School Closures During COVID-19: Opportunities for Innovation in Meal Service." *American Journal of Public Health* 110(11): 1635-1643.

Food trays are one potential source of food contamination, especially if the food placed on or within the tray is not covered and remains exposed to the surrounding environment. Many meals, especially those in congregate living settings, are served on uncovered plates or trays, including paper and cardboard products. While it may be cost-effective to minimize packaging in this manner, such food service practices fail to protect against food contamination and do not promote ease of transportation away from crowded food preparation and distribution settings. Meal providers must quickly alter their food service practices in order to address the rising demand for portable containers specifically designed to address deficiencies in container storage and food packaging, storage, transportation, and consumption.

Accordingly, there is a need for a container designed for easy storage before use, rapid covering, securing, and stacking after filling with food, safe and hygienic transport, and efficient uncovering and re-covering during consumption of the contained food product.

BRIEF SUMMARY OF THE INVENTION

In an exemplary container embodying the principles of the present invention, a lid is formed from a unitary paperboard blank that is cut, creased, and slitted and a tray is formed from a unitary paperboard blank that is cut, creased, folded, and adhered. Such exemplary embodiment of the present invention comprises a lid with catch tabs that interlock with tray catch tab gaps, wings that compress against tray glue flaps, and wing shoulders that compress against tray friction tabs upon engagement of the lid with the tray. Engagement of at least one wing against at least one glue flap comprises a catching mechanism that may be quickly engaged and disengaged by an end user to cover and uncover the tray with the lid. Engagement of a plurality of wings against a plurality of glue flaps comprises a plurality of catching mechanisms that enhance engagement of the lid with the tray.

In an exemplary embodiment of the present invention, the lid also comprises flange flaps that may be folded to fit within the tray interior to further secure the lid on the tray and maximize container stacking strength. The planar lid and nesting tray of this embodiment of the present invention minimize space requirements during storage, thereby achieving desirable transportation and storage economies. This embodiment maximizes protection of food contents from contamination, and distributors and consumers of food products packaged by this embodiment of the invention may more safely and confidently distribute and transport the container with its food contents.

In an embodiment, a stackable container comprises a tray and a lid, wherein the lid comprises a pair of flange flaps foldably attached to a center panel and a pair of catch tabs foldably attached to the center panel, wherein each catch tab comprises a pair of wing slits, and wherein the tray comprises a pair of side panels foldably attached to a bottom panel and a pair of end panels foldably attached to the bottom panel, wherein each end panel comprises a pair of friction tabs.

In an embodiment, the friction tabs secure within the wing slits in a stackable position. In an embodiment, the stackable position comprises the pair of side panels folded substantially perpendicular relative to the bottom panel, and the pair of end panels folded substantially perpendicular relative to the bottom panel. In an embodiment, each catch tab is folded along a catch tab crease. In an embodiment, each end panel comprises a pair of glue flaps securing each end panel to adjacent side panels. In an embodiment, a catch tab gap is located between the friction tabs of each pair of friction tabs. In an embodiment, each side panel comprises a side panel edge, each end panel comprises an end panel edge, and each friction tab comprises a friction tab edge. In an embodiment, each catch tab comprises a pair of wings and a pair of wing shoulders. In an embodiment, the stackable position comprises the friction tabs extending through the wing slits, the catch tabs interlocking with the catch tab gaps, the wings compressed against the glue flaps, and the wing shoulders compressed against the friction tabs. In an embodiment, engagement of at least one wing against at least one glue flap comprises a catching mechanism that secures the lid to the tray. In an embodiment, the container is made of paperboard and the center panel comprises at least one window.

In an embodiment, the stackable position comprises the pair of flange flaps folded substantially perpendicular relative to the center panel, and the pair of catch tabs folded substantially perpendicular relative to the center panel. In an embodiment, each flange flap is folded along a flange flap crease. In an embodiment, each flange flap comprises a pair of flange flap tabs and a pair of flange flap shoulders. In an embodiment, the pair of flange flaps secures within an interior of the tray in a stackable position.

In accordance with the invention, blanks of diverse sizes, shapes, materials, and coatings may be used to manufacture containers of diverse sizes and shapes, within the ambit of the inventive attributes described herein, to meet the needs of various food service industries. In a first exemplary embodiment of the invention, the paperboard blanks are composed of standard solid bleached sulfate (SBS). In additional embodiments the paperboard blanks are unbleached but alternatively treated to create printable and wet-resistant materials suitable for use in the food service industry. In additional embodiments of the invention, the blanks are composed of containerboard, including both linerboard and corrugating medium, which may be double-walled, bleached, or treated and may exhibit alternative fluting sizes and directions. Alternative embodiments may exhibit alternative stiffness-to-weight ratios as well as alternative properties of oil- and grease-resistance, moisture and temperature resistance, printing, texturing, coloring, and sustainability and repulping. Alternative embodiments may include square and rectangular designs. Furthermore, particular embodiments may within the inventive concepts described herein include printing on the blanks, to include graphical or written descriptions of proper usage including flange flap folding and engaging and disengaging the catching mechanisms.

It is an object of the present invention to provide a new container and method of container assembly to allow efficient storage of container components before use and rapid covering and uncovering of the tray with a lid to assemble and disassemble the enclosed container. It is another object of the present invention to provide efficient stacking of the assembled storage containers with food contents inside and safe transportation of the container without exposing the food contents to the surrounding environment.

BRIEF DESCRIPTION OF THE DRAWINGS

The unique attributes of the stackable container with lid are presented in a detailed exemplary embodiment below. Chiefly, the apparatus described in this application is designed for optimal manufacturing, storage, assembly, and usage, including enhanced food hygiene, storage, and transportation and container stacking strength. The present invention is not intended to be limited to the subject matter and exemplary embodiments presently disclosed, and modifications and other embodiments that will come to mind to one skilled in the art having the benefit of the present teachings are within the scope of this disclosure.

Embodiments of the present invention are better understood from the following detailed description with reference to the following drawings.

DETAILED DESCRIPTION OF CERTAIN EMBODIMENTS

Figure 1A:
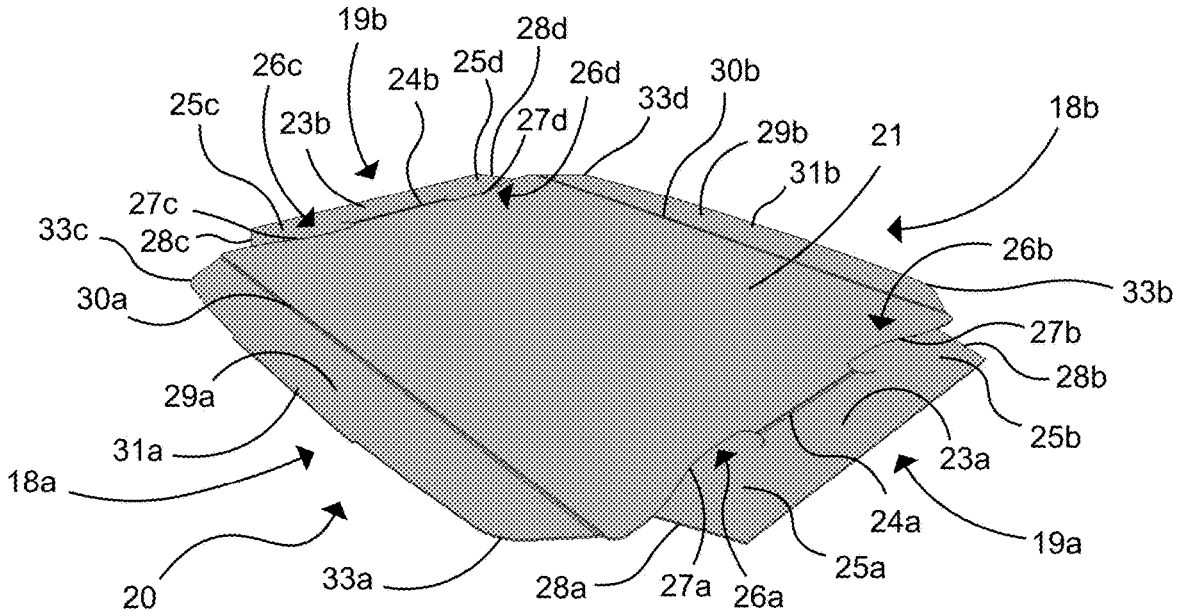
FIG. 1A is a perspective view of an exemplary flat lid of the present invention.
Figure 1B:
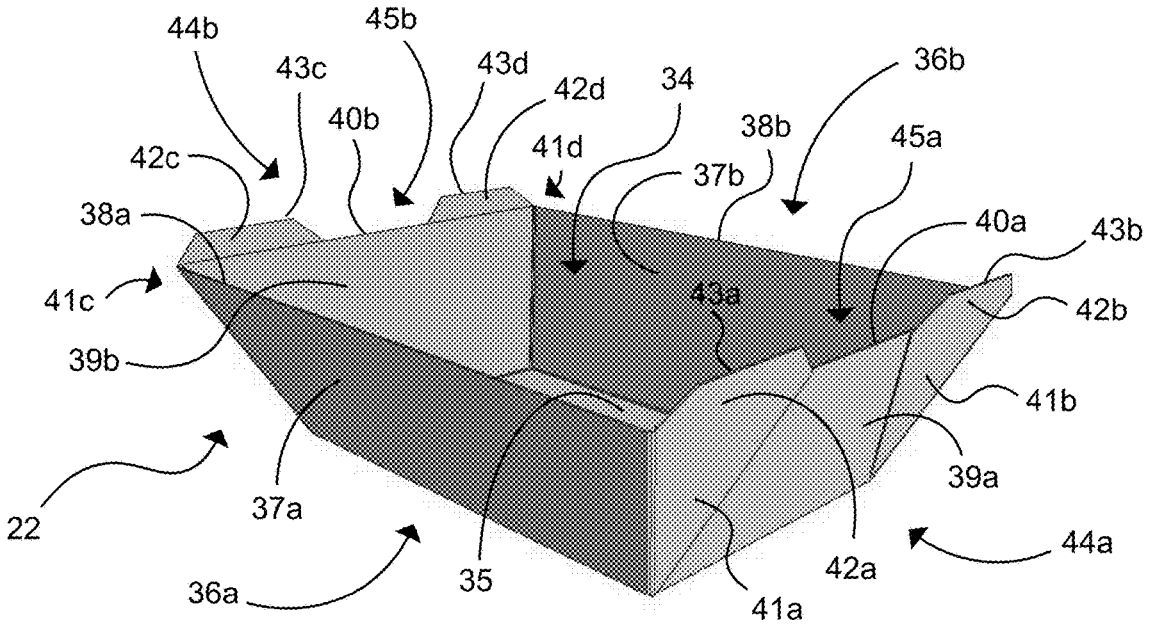
FIG. 1B is a perspective view of an exemplary tray of the present invention.

As depicted in FIGS. 1A and 1B, an exemplary rectangular embodiment of the novel container is aligned in an orientation of assembly with separate lid 20 shown in FIG. 1A and tray 22 shown in FIG. 1B.

Referring now to FIG. 1A, an exemplary lid 20 is formed from a unitary paperboard blank that is cut, creased, and slitted to form elements that engage with elements of the tray to cover and enclose the tray and enhance container stacking strength. The lid 20 may have four sides, namely catch tab sides 19*a* and 19*b* and flange flap sides 18*a* and 18*b*. The lid may comprise a pair of flange flaps, namely flange flaps 29*a* and 29*b* on flange flap sides 18*a* and 18*b*, respectively, wherein the pair of flange flaps is foldably attached to the center panel 21 by flange flap creases 30*a* and 30*b*, respectively, running the lengths of each parallel side. The lid may comprise a pair of catch tabs, namely catch tabs 23*a* and 23*b* on catch tab sides 19*a* and 19*b*, respectively, wherein the pair of catch tabs is foldably attached to the center panel 21 by catch tab creases 24*a* and 24*b*, respectively, running the lengths of each parallel side. In this exemplary embodiment, catch tab creases 24*a* and 24*b* and flange flap creases 30*a* and 30*b* are straight lines and center panel 21 is rectangular.

Alternative embodiments anticipated herein may exhibit alternative crease geometries for some or all creases, including curved or multi-segmented geometries, or any other geometry. Center panel 21 may exhibit alternative shapes, including rectilinear (e.g., rectangular or square), rounded rectangular, bulging rectangular, curved rectangular, or any other shape. Center panel 21, side panels 37*a* and 37*b*, and end panels 39*a* and 39*b* may also include windows and window films of diverse sizes, shapes, and materials. For example, alternative embodiments anticipated herein may include windows of various shapes, including circles, triangles, rectangles, stars, diamonds, ovals, semicircles, hearts, hexagons, pentagons, trapezoids, crosses, crescents, parallelograms, octagons, and combinations thereof. Windows may be made of clear, colored, opaque, and/or translucent materials and combinations thereof, including cellophane and other suitable thin films.

Each catch tab comprises a pair of wing slits and wings, wherein each wing comprises a wing shoulder and a wing end. For example, catch tab 23*a* comprises wing slits 26*a* and 26*b* and wings 25*a* and 25*b*. Wings 25*a* and 25*b* comprise wing shoulders 27*a* and 27*b*, respectively, and wing ends 28*a* and 28*b*, respectively. Similarly, catch tab 23*b* comprises wing slits 26*c* and 26*d* and wings 25*c* and 25*d*. Wings 25*c* and 25*d* comprise wing shoulders 27*c* and 27*d*, respectively, and wing ends 28*c* and 28*d*, respectively.

The curvatures of wing slits 26*a*, 26*b*, 26*c*, and 26*d* delineate the shapes of wing shoulders 27*a*, 27*b*, 27*c*, and 27*d*, respectively, and thus the wing slit curvatures define the overall shape of wings 25*a*, 25*b*, 25*c*, and 25*d*. The shapes of wings 25*a* and 25*b* define the overall shape of catch tab 23*a*, and the shapes of wings 25*c* and 25*d* define the overall shape of catch tab 23*b*.

In an exemplary embodiment, wing slits 26*a*, 26*b*, 26*c*, and 26*d* are curved. Wing slits 26*a*, 26*b*, 26*c*, and 26*d* are separated from center panel 21 by narrow, Bézier curve-shaped cuts such that wing shoulders 27*a*, 27*b*, 27*c*, and 27*d* are separated from center panel 21 only by narrow slits. Herein, the angle between each wing end and its corresponding wing shoulder is about perpendicular. From the point where each wing end meets its corresponding wing shoulder, each wing slit curves toward the center of center panel 21, then each wing slit curves back away from center panel 21 in a semi-circular shape at each corresponding catch tab crease to terminate pointing toward the wing end. Thus, in this exemplary embodiment wing shoulders 27*a*, 27*b*, 27*c*, and 27*d* exhibit rounded edges due to the curvatures of wing slits 26*a*, 26*b*, 26*c*, and 26*d*, respectively.

Alternative embodiments anticipated herein may exhibit alternative catch tab lengths, widths, and creasing patterns, alternative catch tab crease curvatures and lengths, alternative wing slit lengths and widths, alternative wing shoulder angles, curvatures, and shapes, and alternative wing lengths and widths within a range in order to modulate the properties of the catching mechanisms. Herein, the lengths of the catch tab sides of the lid are about equal to the lengths of the catch tabs themselves, and widths of the catch tabs measure about one tenth the lengths of the catch tab sides. Alternative embodiments anticipated herein include lengths of catch tabs less than lengths of the catch tab sides, and widths of catch tabs greater or less than one tenth the length of the catch tab sides in order to modulate properties of the catching mechanisms. Alternative embodiments may also include linear and non-linear catch tab creases and longer or shorter catch tab creases. Alternative embodiments anticipated herein may also exhibit different creasing patterns on the wings to further modulate properties of the catching mechanisms, including linear and nonlinear creases. Herein, narrow slits separate wings from the center panel and delineate wing shoulder shape. Alternative embodiments anticipated herein include greater wing slit widths, including slots made by removing narrow strips of substrate, longer or shorter wing and wing slit lengths, and various wing slit curvatures, including linear and non-linear curves. These alternative embodiments enable modulation of properties of the catching mechanisms that engage the lid with the tray and permit optimization of engagement and disengagement depending on the materials used to fabricate the lid and tray and the intended container use.

Referring to FIG. 1A, the lid 20 may comprise a pair of flange flaps 29*a* and 29*b* foldably attached to center panel 21, wherein each flange flap comprises a pair of flange flap tabs and a pair of flange flap shoulders. Flange flap 29*a* on flange flap side 18*a* comprises flange flap tab 31*a* and flange flap shoulders 33*a* and 33*c*. Flange flap 29*b* on flange flap side 18*b* comprises flange flap tab 31*b* and flange flap shoulders 33*b* and 33*d*. Alternative embodiments anticipated herein may exhibit alternative flange flap lengths, widths and creasing patterns, alternative flange flap tab lengths, widths and curvatures, and alternative flange flap shoulder curvatures and shapes. Herein, the lengths of the flange flap sides are about equal to the lengths of the flange flaps themselves, and the widths of the flange flaps are about one tenth the length of the flange flap sides. Alternative embodiments anticipated herein include lengths of flange flaps less than lengths of flange flap sides, and widths of flange flaps greater than or less than one tenth the length of the flange flap sides in order to modulate properties of container stacking strength. Alternative embodiments may also include linear or non-linear flange flap creases, which may delineate alternative center panel 21 shapes, including rectilinear (e.g., rectangular or square), rounded rectangular, bulging rectangular, curved rectangular, or any other shape.

Referring to FIG. 1B, the tray 22 may be assembled by folding and adhering some elements. The tray 22 comprises sides 36*a* and 36*b* and ends 44*a* and 44*b*. Side panels 37*a* and 37*b*, end panels 39*a* and 39*b*, and bottom panel 35 delineate the interior 34 of tray 22. In this configuration, the top of tray 22 is open to the surrounding environment and its rectilinear shape is delineated by side panel edges 38*a* and 38*b* and end panel edges 40*a* and 40*b*. Alternative embodiments anticipated herein may exhibit alternative top shapes, including rectilinear (e.g., rectangular or square), rounded rectangular, bulging rectangular, curved rectangular, or any other shape.

Each end panel comprises a pair of glue flaps securing each end panel to the adjacent side panels; each corner of tray 22 is strengthened by a glue flap. Glue flaps 41*a* and 41*b* are adhered to end panel 39*a*, securing end panel 39*a* to adjacent side panels 37*a* and 37*b* at end 44*a*. Similarly, glue flaps 41*c* and 41*d* are adhered to end panel 39*b*, securing end panel 39*b* to adjacent side panels 37*a* and 37*b* at end 44*b*.

Each end panel comprises a pair of friction tabs. Friction tabs 42*a*, 42*b*, 42*c*, and 42*d* protrude above the tray top from glue flaps 41*a*, 41*b*, 41*c*, and 41*d*, respectively, and terminate with friction tab edges 43*a*, 43*b*, 43*c*, and 43*d*, respectively. Catch tab gaps are located between the friction tabs of each pair of friction tabs. Thus, catch tab gap 45*a* is located between friction tabs 42*a* and 42*b*, and catch tab gap 45*a* is further delineated by end panel edge 40*a*. Similarly, catch tab gap 45*b* is located between friction tabs 42*c* and 42*d*, and catch tab gap 45*b* is further delineated by end panel edge 4*b*.

Alternative embodiments anticipated herein may exhibit alternative tray dimensions, including alternative end, side, and bottom panel lengths and widths, alternative glue flap geometries, alternative friction tab lengths and widths, alternative friction tab edge curvatures, and alternative catch tab gap lengths and widths. Herein, friction tab lengths are about two fifths the length of the end lengths at the tray top and friction tab widths are about one seventh the height of the tray. Alternative embodiments include greater or lesser friction tab lengths and widths. Herein, catch tab gaps are about three tenths the length of the end lengths at the tray top and catch tab gaps are about one seventh the height of the tray. Alternative embodiments include greater or lesser catch tab gap lengths and widths.

Figure 2A:
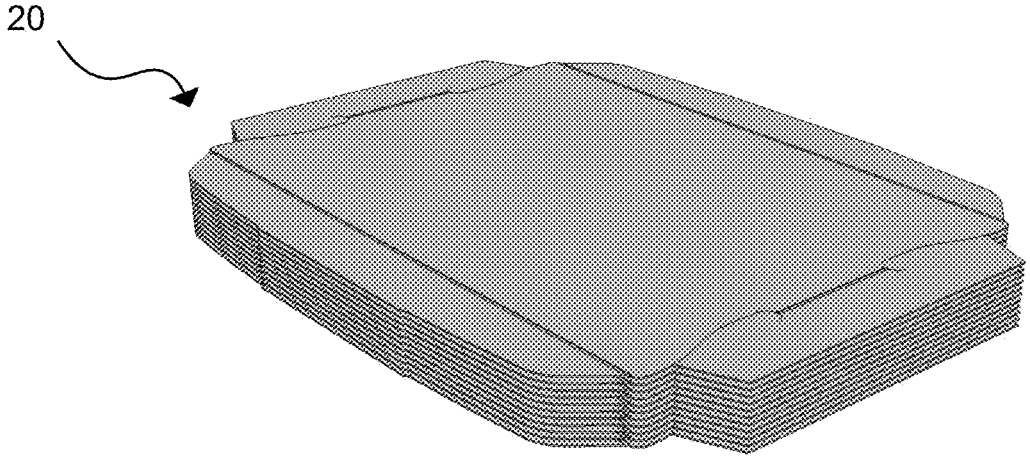
FIG. 2A is a perspective view of a plurality of flat lids of FIG. 1A stacked for storage or shipping.
Figure 2B:
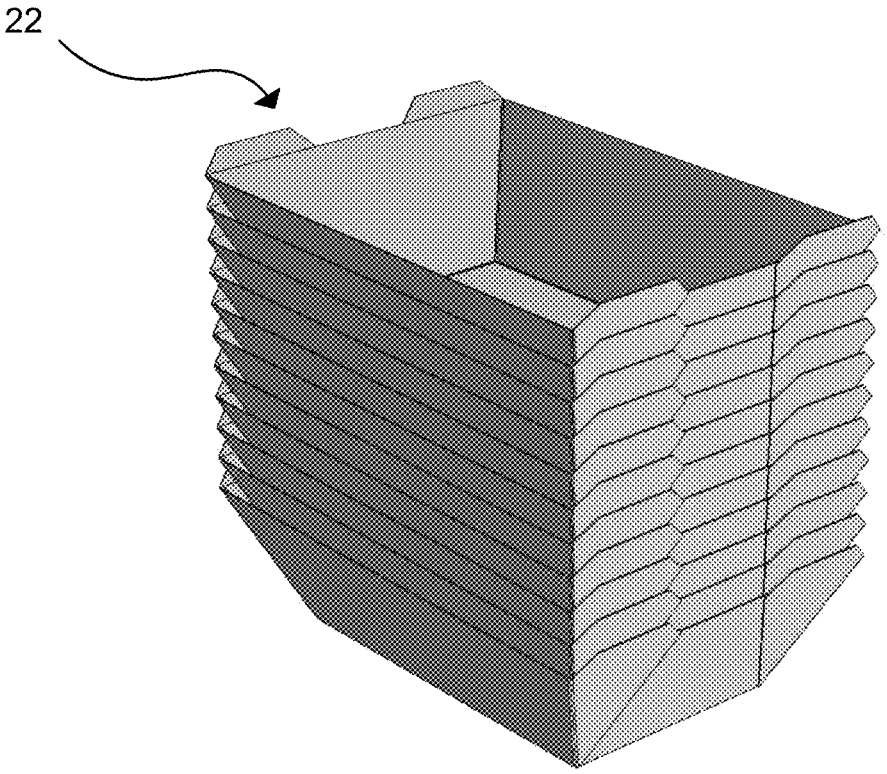
FIG. 2B is a perspective view of a plurality of trays of FIG. 1B stacked for storage or shipping.

In FIG. 2A, a plurality of lids 20 of FIG. 1A is depicted stacked for storage or shipping, and in FIG. 2B, a plurality of trays 22 of FIG. 1B is depicted stacked for storage or shipping. Trays may be stacked wherein each tray is nested within the interior of the tray immediately below it.

Figure 3A:
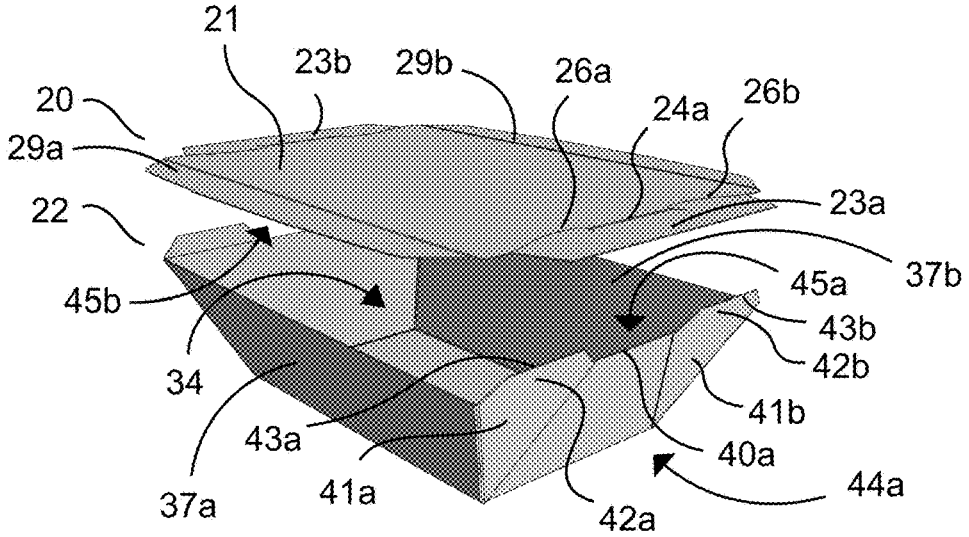
FIG. 3A is a perspective view of a flat lid of FIG. 1A aligned in an orientation for assembly with a tray of FIG. 1B.
Figure 3B:
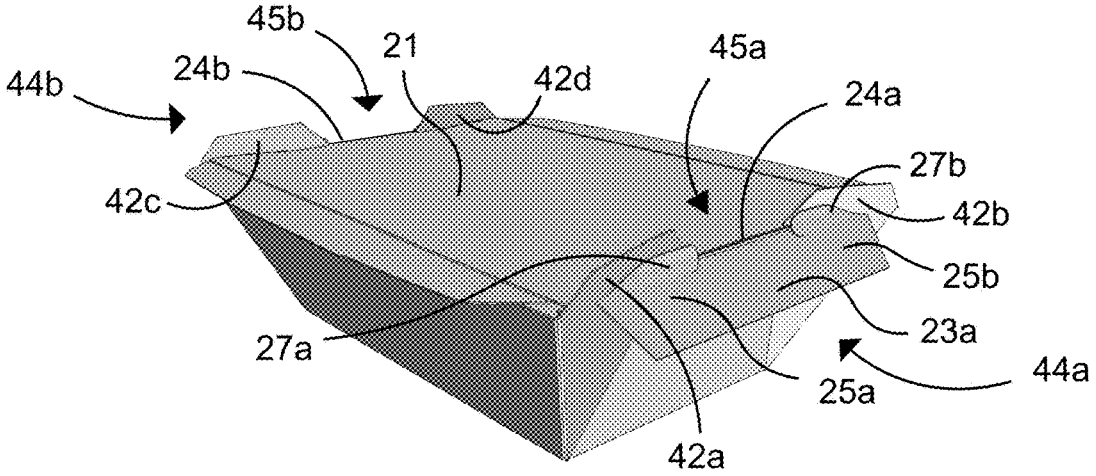
FIG. 3B is a perspective view of the lid and tray of FIG. 3A showing the lid partially folded along the catch tab crease and lid catch tabs partially interlocking with the tray catch tab gaps.
Figure 3C:
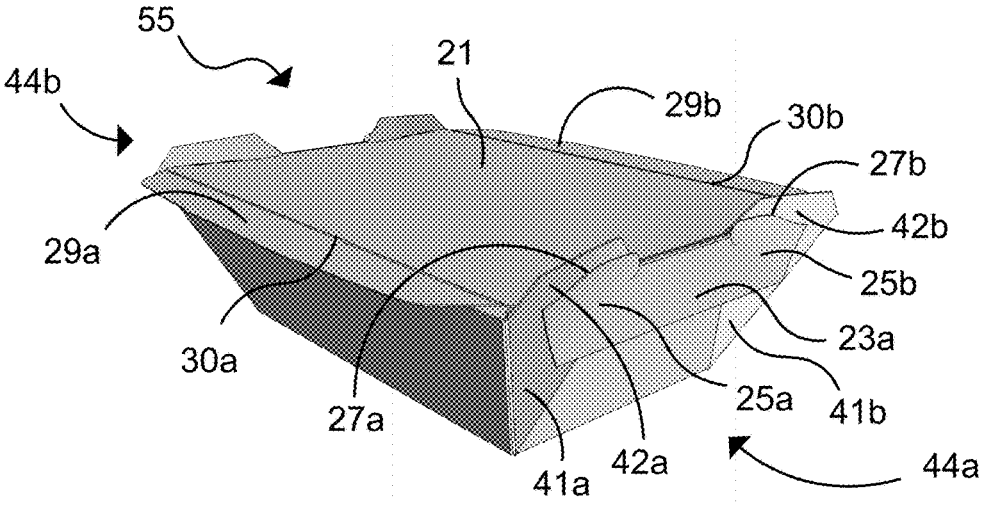
FIG. 3C is a perspective view of the lid and tray of FIG. 3A showing the lid fully folded along the catch tab crease and lid catch tabs interlocking with the tray catch tab gaps to form a container in a stackable position.

Referring now to FIGS. 3A, 3B, and 3C, the embodiments of FIG. 1A and FIG. 1B are aligned in an orientation of assembly to form container 55. In FIG. 3A, lid 20 is aligned with tray 22 so that catch tabs 23*a* and 23*b* align with catch tab gaps 45*a* and 45*b*, respectively. This orientation also aligns flange flaps 29*a* and 29*b* with side panels 37*a* and 37*b*, respectively. Alignment of catch tabs with catch tab gaps and flange flaps with side panels orients lid 20 with respect to tray 22 to cover interior 34 with center panel 21 and align the catching mechanisms. In alternative embodiments anticipated herein, the catching mechanisms may be engaged when elements are not perfectly aligned and across a wide range of alternative catch tab lengths, widths, and creasing patterns, alternative catch tab crease curvatures and lengths, alternative wing slit lengths and widths, alternative wing shoulder curvatures and shapes, and alternative wing lengths and widths.

Now referring to end 44*a* of FIG. 3A as an exemplary depiction of catching mechanisms that secure lid 20 to tray 22, elements are aligned to engage at least one wing against at least one glue flap. Namely, end panel edge 40*a* is aligned with catch tab crease 24*a*; glue flap 41*a*, friction tab 42*a*, and friction tab edge 43*a* are aligned with wing slit 26*a*; and glue flap 41*b*, friction tab 42*b*, and friction tab edge 43*b* are aligned with wing slit 26*b*. Similar alignments at end 44*b* ensure that elements are aligned to engage at least one wing against at least one glue flap.

In FIG. 3B, lid 20 is aligned with and on top of tray 22. Downward pressure is applied to catch tabs 23*a* and 23*b* to begin engaging the catching mechanisms at ends 44*a* and 44*b*. Lid 20 is partially folded along catch tab creases 24*a* and 24*b* so that catch tabs 23*a* and 23*b*, respectively, interlock with catch tab gaps 45*a* and 45*b*, respectively.

Now referring to end 44*a* of FIG. 3B as an exemplary depiction of catching mechanisms that secure lid 20 to tray 22, engagement of at least one wing against at least one glue flap comprises a catching mechanism. For example, when catch tab 23*a* interlocks with catch tab gap 45*a*, friction tabs 42*a* and 42*b* extend through wing slits 26*a* and 26*b*, respectively, separating wings 25*a* and 25*b*, respectively, from center panel 21. Friction tabs 42*a* and 42*b* secure within wing slits 26*a* and 26*b*, respectively. Wing shoulders 27*a* and 27*b* are compressed against friction tabs 42*a* and 42*b*, respectively, creating the friction integral to the catching mechanisms. Similar engagements at end 44*b* create the friction integral to the catching mechanisms.

Figure 5A:
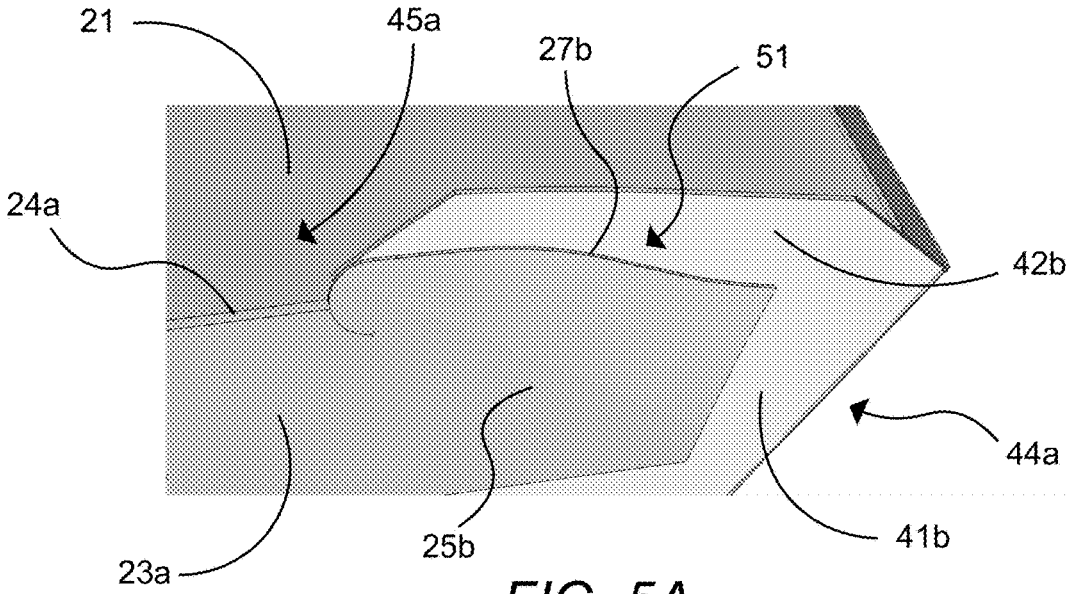
FIG. 5A is an isolation exterior perspective view of a corner of the lid and tray of FIG. 4C showing a catch tab fully folded along the catch tab crease, a wing compressed against a glue flap, and a wing shoulder compressed against a friction tab as a catching mechanism.
Figure 5B:
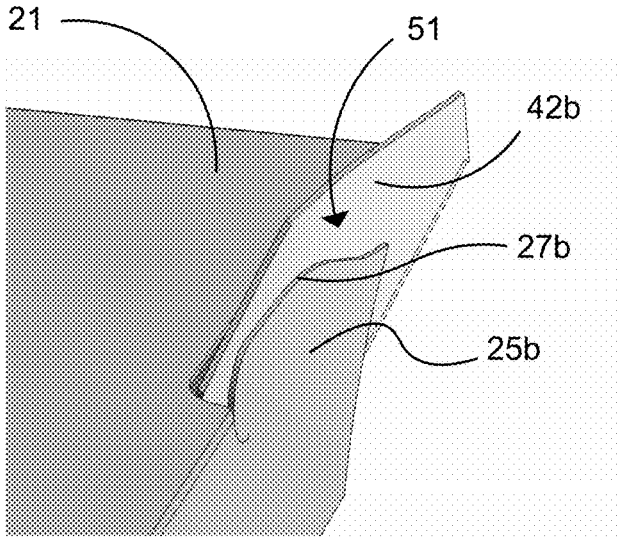
FIG. 5B is an isolation exterior perspective view of the corner of FIG. 5A showing the catching mechanism.
Figure 5C:
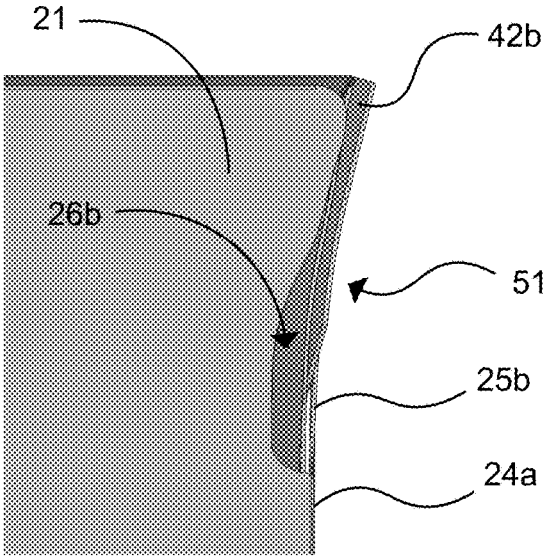
FIG. 5C is an isolation exterior perspective view of the corner of FIG. 5A showing the catching mechanism and a flange flap secured within the interior of the tray.

Referring to the depiction of a catching mechanism of FIGS. 5A, 5B, and 5C, engagement of wing 25*b* against glue flap 41*b* comprises a catching mechanism that secures the lid to the tray. In this exemplary embodiment, folding catch tab 23*a* down and inward toward the interior of the container and compressing wing 25*b* against glue flap 41*b* engages a catching mechanism at end 44*a*. Engagement of both catching mechanisms at end 44*a* results in friction tabs 42*a* and 42*b* protruding above center panel 21 through wing slits 26*a* and 26*b*, respectively. Similarly, engagement of both catching mechanisms at end 44*b* results in friction tabs 42*c* and 42*d* protruding above center panel 21 through wing slits 26*c* and 26*d*, respectively.

In FIG. 3C, the catching mechanisms at ends 44*a* and 44*b* are fully engaged so lid 20 and tray 22 form container 55 in a stackable position. Lid 20 is fully folded along catch tab creases 24*a* and 24*b* so that catch tabs 23*a* and 23*b*, respectively, fully interlock with catch tab gaps 45*a* and 45*b*, respectively, and are fully compressed against ends 44*a* and 44*b*, respectively.

Now referring to end 44*a* of FIG. 3C as an exemplary depiction of catching mechanisms, wings 25*a* and 25*b* are compressed against glue flaps 41*a* and 41*b*, respectively and wing shoulders 27*a* and 27*b* are compressed against friction tabs 42*a* and 42*b*, respectively. The plane of wing 25*a* is adjacent to the plane of glue flap 41*a* and the plane of wing 25*b* is adjacent to the plane of glue flap 41*b*. The friction from engagement of the wings against the glue flaps comprises the catching mechanisms at end 44*a*. Similarly, the plane of wing 25*c* is adjacent to the plane of glue flap 41*c* and the plane of wing 25*d* is adjacent to the plane of glue flap 41*d*. The friction from engagement of the wings against the glue flaps comprises the catching mechanisms at end 44*b*.

As depicted in FIG. 3C, an exemplary embodiment container 55 may exhibit unfolded flange flaps, requiring fewer folding steps to assemble. In this configuration, the flange flap creases 30*a* and 30*b* are not folded such that flange flaps 29*a* and 29*b* are coplanar with center panel 21. This configuration may be simpler and faster for food preparers, distributers, transporters, and consumers to use.

Figure 4A:
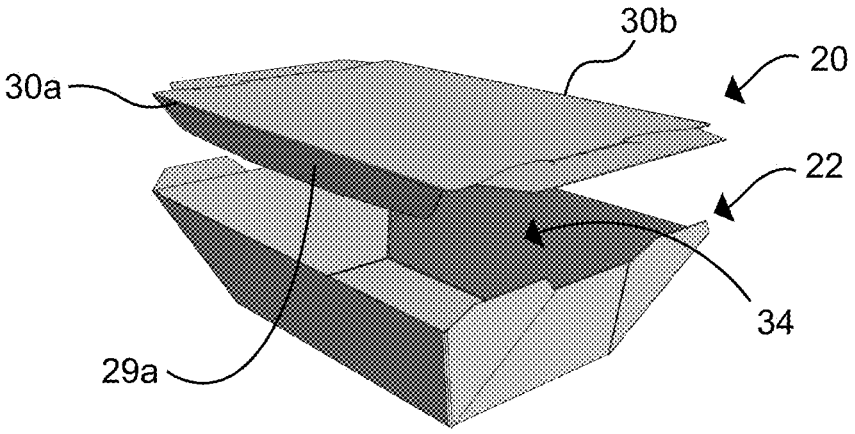
FIG. 4A is a perspective view of a lid of FIG. 1A aligned in an orientation for assembly with a tray of FIG. 1B wherein the lid flange flaps are in a folded position.
Figure 4B:
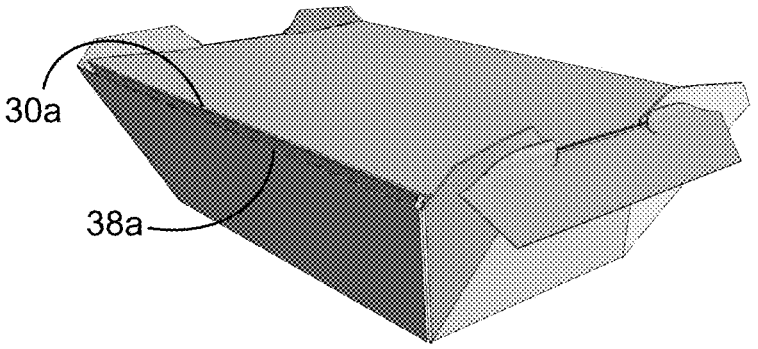
FIG. 4B is a perspective view of the lid and tray of FIG. 4A showing the folded lid flange flaps secured within the interior of the tray and showing the lid partially folded along the catch tab crease and lid catch tabs partially interlocking with the tray catch tab gaps.
Figure 4C:
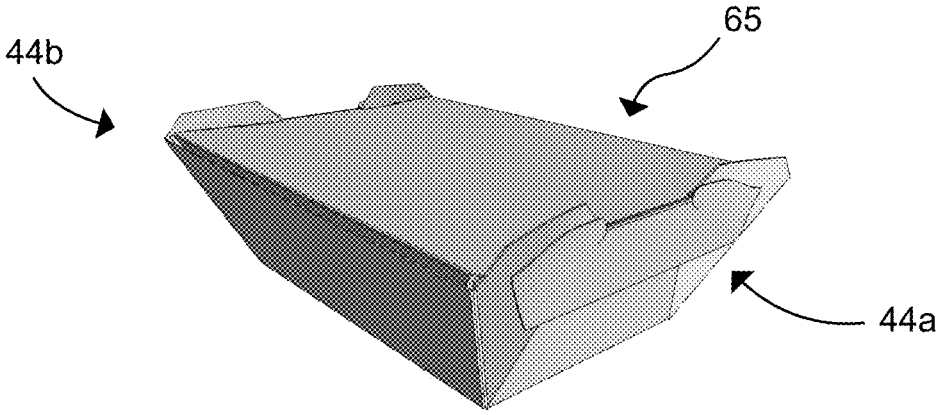
FIG. 4C is a perspective view of the lid and tray of FIG. 4A showing folded lid flange flaps secured within the interior of the tray and the lid fully folded along the catch tab crease and lid catch tabs fully interlocking with the tray catch tab gaps to form a container in a stackable position.

Referring now to FIGS. 4A, 4B, and 4C, the embodiments of FIG. 1A and FIG. 1B are aligned in an orientation of assembly and flange flaps are in a folded position to form container 65. In FIG. 4A, lid 20 is aligned with tray 22 as described above so that at least one catching mechanism is aligned. Flange flap creases 30*a* and 30*b* are folded so that flange flaps 29*a* and 29*b*, respectively, are angled toward the interior 34 of tray 22. In FIG. 4B, lid 20 is aligned with and on top of tray 22 and downward pressure is applied to begin engaging the catching mechanisms at ends 44*a* and 44*b* as described above. Flange flaps 29*a* and 29*b* are contained within interior 34, and flange flap creases 30*a* and 30*b* are adjacent to side panel edges 38*a* and 38*b*, respectively. In FIG. 4C, the catching mechanisms at ends 44*a* and 44*b* are fully engaged as described above so lid 20 and tray 22 form container 65 in a stackable position. Container stacking strength and engagement of the lid with the tray are both enhanced by flange flaps contained within interior 34 of container 65.

Referring now to FIGS. 5A, 5B, and 5C, the catching mechanism 51 of one corner of the embodiment of FIG. 4C is depicted in greater detail. Lid 20 is fully folded along catch tab crease 24*a* and friction tab 42*b* extends through wing slit 26*b*, separating wing 25*b* from center panel 21. Catch tab 23*a* fully interlocks with catch tab gap 45*a* and catch tab 23*a* is fully compressed against end 44*a*. Wing 25*b* is compressed against glue flap 41*b* and wing shoulder 27*b* is compressed against friction tab 42*b* such that the plane of wing 25*b* is adjacent to the plane of glue flap 41*b*. The friction from engagement of the wing against the glue flap comprises a catching mechanism at end 44*a*. Engagement of this catching mechanism at end 44*a* results in friction tab 42*b* protruding above center panel 21 through wing slit 26*b*.

Figure 6:
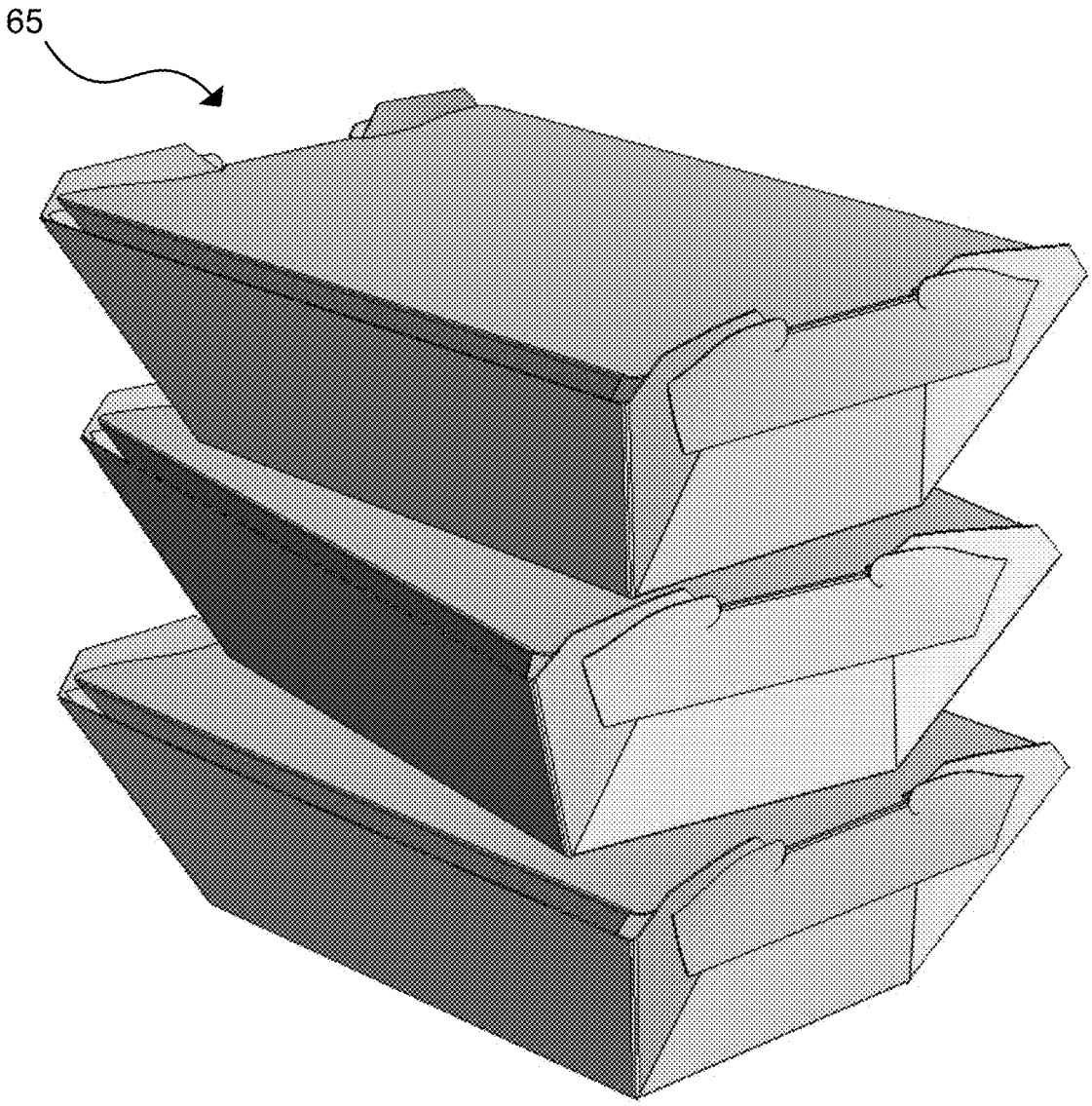
FIG. 6 is a perspective view of a stack of containers of FIG. 4C.

In FIG. 6, a plurality of containers 65 of FIG. 4C are in stackable positions and are stacked for storage or transportation. Each container of this plurality of containers comprises catching mechanisms that secure each lid to each tray and flange flaps that are located inside each container interior. These enclosable, stackable, leak-resistant containers improve food hygiene practices and container stacking strength.

As used herein, the term "about" when referring to a measurable value such as angle, length, height, and the like, encompasses ±20%, ±10%, ±5%, ±1%, ±0.5%, or ±0.1% of the specified amount. As used herein, the term "substantially" when referring to a measurable value such as angle encompasses ±20%, ±10%, ±5%, ±1%, ±0.5%, or ±0.1% of the specified amount.

What is claimed is:

1. A stackable container comprising:

a tray; and a lid, wherein the lid comprises a pair of flange flaps extending coplanar from and attached to a center panel and separately foldable from the center panel in relation to a pair of catch tabs foldably attached to the center panel, wherein each catch tab comprises a pair of wings, a pair of wing slits, and a pair of wing shoulders, wherein the tray comprises a pair of side panels foldably attached to a bottom panel and a pair of end panels foldably attached to the bottom panel, wherein each end panel comprises a pair of friction tabs, wherein each pair of friction tabs secures within each pair of wing slits and compresses against each pair of wing shoulders in a stackable position, wherein compression of the friction tabs against the wing shoulders comprises a catching mechanism that secures the lid to the tray.

2. The stackable container of claim 1, wherein the stackable position comprises the pair of side panels folded substantially perpendicular relative to the bottom panel, and the pair of end panels folded substantially perpendicular relative to the bottom panel.

3. The stackable container of claim 1, wherein each catch tab is folded along a catch tab crease.

4. The stackable container of claim 1, wherein each end panel comprises a pair of glue flaps securing each end panel to adjacent side panels.

5. The stackable container of claim 1, wherein a catch tab gap is located between the friction tabs of each pair of friction tabs.

6. The stackable container of claim 1, wherein each side panel comprises a side panel edge, wherein each end panel comprises an end panel edge, and wherein each friction tab comprises a friction tab edge.

7. The stackable container of claim 1, wherein each catch tab comprises wing slits and wing shoulders shaped to accommodate the friction tabs on the glue flaps of the tray in the stackable position.

8. The stackable container of claim 1, wherein the stackable position comprises the friction tabs extending through the wing slits, the catch tabs interlocking with the catch tab gaps, the wings compressed against the glue flaps, and the wing shoulders compressed against the friction tabs.

9. The stackable container of claim 1, wherein the container is made of paperboard and the center panel comprises at least one window.

10. The stackable container of claim 9, wherein the stackable position comprises the pair of side panels folded substantially perpendicular relative to the bottom panel, the pair of end panels folded substantially perpendicular relative to the bottom panel, the pair of flange flaps folded substantially perpendicular relative to the center panel, and the pair of catch tabs folded substantially perpendicular relative to the center panel.

11. The stackable container of claim 9, wherein each catch tab is folded along a catch tab crease and each flange flap is folded along a flange flap crease.

12. The stackable container of claim 9, wherein a catch tab gap is located between the friction tabs of each pair of friction tabs.

13. The stackable container of claim 9, wherein each side panel comprises a side panel edge, wherein each end panel comprises an end panel edge, and wherein each friction tab comprises a friction tab edge.

14. The stackable container of claim 9, wherein each catch tab comprises wing slits and wing shoulders shaped to accommodate the friction tabs on the glue flaps of the tray in the stackable position, and each flange flap comprises a pair of flange flap tabs and a pair of flange flap shoulders.

15. The stackable container of claim 9, wherein the stackable position comprises the friction tabs extending through the wing slits, the catch tabs interlocking with the catch tab gaps, the wings compressed against the glue flaps, and the wing shoulders compressed against the friction tabs.

16. The stackable container of claim 9, wherein the pair of flange flaps secures within an interior of the tray in a stackable position.

17. A stackable container comprising:

a tray; and a lid, wherein the lid comprises a pair of flange flaps foldably attached to a center panel and a pair of catch tabs foldably attached to the center panel, wherein each catch tab comprises a pair of wings, a pair of wing slits, and a pair of wing shoulders, wherein the tray comprises a pair of side panels foldably attached to a bottom panel and a pair of end panels foldably attached to the bottom panel, wherein each end panel comprises a pair of friction tabs and a pair of glue flaps securing each end panel to the adjacent side panels, wherein each pair of friction tabs secures within each pair of wing slits and compresses against each pair of wing shoulders in a stackable position, wherein compression of the friction tabs against the wing shoulders comprises a catching mechanism that secures the lid to the tray.

* * * * *